US006089176A

United States Patent [19]

Costello

[11] Patent Number: 6,089,176

[45] Date of Patent: Jul. 18, 2000

[54] APPARATUS FOR AND A METHOD OF CONSTRUCTING A FLOATING DOCK STRUCTURE

[76] Inventor: John Alexander Costello, 415 Wiggins La., Greenport, N.Y. 19944

[21] Appl. No.: 09/374,959

[22] Filed: Aug. 16, 1999

[51] Int. Cl.[7] ..... B63B 35/44

[52] U.S. Cl. ..... 114/267; 114/263; 114/264; 114/266; 405/218; 405/219

[58] Field of Search ..... 114/267, 263, 114/264, 266, 283, 292; 405/218, 219, 221, 68; 441/44, 45

[56] References Cited

U.S. PATENT DOCUMENTS

| | | | |
|---|---|---|---|
| 3,090,339 | 5/1963 | Carr | 114/292 |
| 3,620,027 | 11/1971 | Nordell . | |
| 3,726,098 | 4/1973 | Alms et al. . | |
| 3,760,754 | 9/1973 | Drummond et al. . | |
| 4,418,634 | 12/1983 | Gerbus | 114/263 |
| 4,602,587 | 7/1986 | Lyons . | |
| 4,768,456 | 9/1988 | Jones et al. . | |
| 4,829,928 | 5/1989 | Bergman | 114/264 |
| 4,867,093 | 9/1989 | Sullivan . | |
| 4,926,776 | 5/1990 | Corbett . | |
| 4,979,453 | 12/1990 | Sloan et al. . | |
| 4,981,391 | 1/1991 | Klementovich | 405/68 |
| 5,056,452 | 10/1991 | McCain | 114/263 |
| 5,199,370 | 4/1993 | Berquist . | |
| 5,199,371 | 4/1993 | Meriwether . | |
| 5,281,055 | 1/1994 | Neitzke et al. . | |
| 5,355,825 | 10/1994 | Lefebvre et al. . | |
| 5,390,620 | 2/1995 | Murphy et al. . | |
| 5,404,825 | 4/1995 | McElwain . | |
| 5,743,205 | 4/1998 | Morris | 114/266 |
| 5,799,916 | 9/1998 | Lechner . | |
| 5,823,132 | 10/1998 | Donavon | 114/266 |
| 5,870,964 | 2/1999 | Gerber et al. . | |
| 5,888,024 | 3/1999 | Mills et al. . | |

*Primary Examiner*—S. Joseph Morano
*Assistant Examiner*—Lars A. Olson
*Attorney, Agent, or Firm*—John J. Skinner, Jr.; Albert J. Breneisen; Kenyon & Kenyon

[57] ABSTRACT

An apparatus of and a method for the construction of an environmentally-friendly floating dock structure using heavy-gauge plastic tubing as pontoon floats with an overlying series of deck crosspieces is presented. The plastic pontoon floats are made from a high-density polyethylene material and arranged with the overlying deck crosspieces in such a manner as to provide the floating dock with a greater degree of stability, and are themselves constructed containing a highly buoyant material. The junctures between the adjoining pieces of the pontoon floats are sealed water-tight by a plastic joining process.

24 Claims, 4 Drawing Sheets

APPARATUS FOR AND A METHOD OF CONSTRUCTING A FLOATING DOCK STRUCTURE

BACKGROUND OF THE INVENTION

1. Field of the Invention

The present invention relates to an apparatus for and a method of constructing a floating dock structure, and more particularly, to constructing a floating dock structure using heavy-gauge plastic tubing as pontoon floats in which the junctures between adjoining pieces of the pontoon floats are sealed water-tight by a plastic joining process. The floating dock structure of this invention experiences no electrolysis, requires no painting, and is impervious to destructive marine borers.

2. Description of the Art

The use of a floating dock structure has become an integral part of today's water recreation and sporting events, such as swimming, snorkeling, scuba diving, boating, canoeing, water skiing, fishing, etc. Similarly, floating docks have various commercial uses such as, for example, at marinas. The dock structure provides a safe and secure place from which to enjoy the activity, and many attempts have been made to provide for such structures.

For example, U.S. Pat. No. 5,888,024, issued Mar. 30, 1999, to Mills et al., relates to a floating dock comprising a pair of flotation tanks, arranged side-by-side in parallel, mounted by a number of semi-circular double-saddle brackets. Each bracket saddles a top half of each of the two flotation tanks, running perpendicular to the length of the tanks, and is secured in place by a semi-circular steel rod wrapped around a bottom half of each of the flotation tanks and then bolted to the bracket. A deck is also bolted to the bracket above the level of the flotation tanks. Unfortunately, should the steel rod or any one of the bolts break or become unbolted, it is possible that the dock structure might break apart when one of the flotation tanks or the deck itself comes loose.

Another example, U.S. Pat. No. 5,056,452, issued Oct. 15, 1991, to McCain, relates to a floating dock with a hinge connection for interconnecting adjacent dock sections to permit vertical and horizontal movement between the sections. The hinge connection comprises complementary fitting yokes and lugs, each respectively welded to the ends of an adjacent float over which the deck sits. The yokes and lugs are secured to one another by a pin which passes through holes bored in the yokes and lugs. Again, unfortunately, should a pin break or become dislodged, or the weld of the hinge connections rust and break, the dock structure could break part.

Yet another example, U.S. Pat. No. 4,926,776, issued May 22, 1990, to Corbett, relates to a floating dock which is vertically adjustable. A pair of pontoons supports a deck section, the pontoons being secured to the deck section via a vertically adjustable pontoon mount. The pontoons themselves are secured to the pontoon mount by circumferential straps. Once again, should the straps break it is possible that the dock structure could break apart.

Thus, as can be seen, there remains a need for a floating dock structure which is solid in construction and yet easy to construct, all weather resistant, maintenance free, easily transportable, and able to maintain a well-balanced equilibrium which is not unduly subject to capsizing.

SUMMARY OF THE INVENTION

Accordingly, the present invention provides for a floating dock structure in which heavy-gauge plastic tubing serves as a secure pontoon float base for an overlying deck. The plastic tubing is preferably a high-density polyethylene or similar material. The pontoon float base comprises a number of individual pontoons each connected to one another in a rectangular pattern designed for increased stability on the water. Structural integrity of the pontoon float base is achieved by a plastic joining of the junctures between the individual pontoons. Support members for the overlying deck are integrally joined to the pontoon float base also by way of a plastic joining process.

The present invention, including its features and advantages, will become more apparent from the following detailed description with reference to the accompanying drawings.

DETAILED DESCRIPTION

Figure 1:
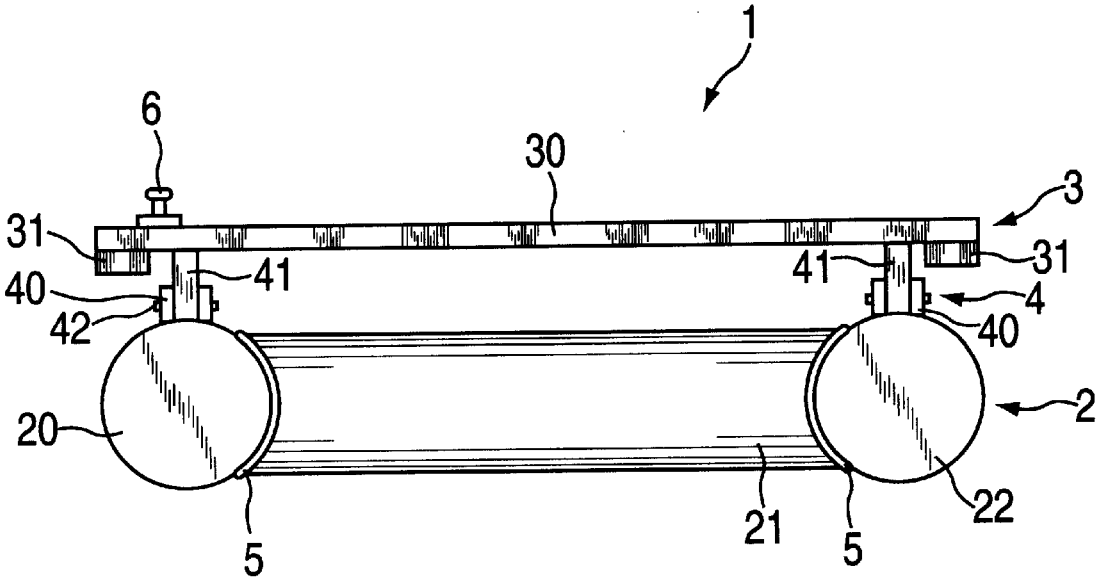
FIG. 1 illustrates an end view of the floating dock structure, according to an embodiment of the present invention.

FIGS. 1 through 6 illustrate a method and apparatus for the construction of a floating dock structure using heavy-gauge, high-density polyethylene plastic tubing as pontoon floats, and in which the junctures between the adjoining pieces of the pontoon floats are sealed water-tight by a plastic joining process. High-density polyethylene is preferred due to its use over a wide range of temperatures without becoming brittle. Of course, other plastic materials may be used dependent upon the environment, including temperature variations in which the dock is to be used. The plastic joining process may be any suitable process in which a heated plastic is formed to achieve a desired seal. Such joining process includes fusion, laser or microwave, and friction or dielectric joining.

Referring to FIGS. 1, 2, 3 and 4, a floating dock structure 1 comprises a pontoon float base 2 over which is constructed a deck 3 and a deck support brace 4. The deck support brace 4 is integrally connected to the pontoon float base 2 by means of a plastic joining of the type described above. Such joining allows for an integral connection between the pontoon float base 2 and the deck support brace 4, providing for stability of construction. Further, as the deck support brace is integrally connected to the pontoon float base 2, the deck 3 can be securely mounted over the pontoon float base 2 by means of the deck support brace 4. On top of deck 3, a number of cleats 6 may also be securely fastened, allowing for the floating dock structure to be moored, or for boats, other floating dock structures, etc., to be tied. Such docks are ideal for use in marinas where many boats are kept.

Turning now to the construction of the pontoon float base 2, it is constructed from a number of pontoons 20, 21, 22 and 23. Pontoons 20, 21, 22 and 23 are preferably constructed of a heavy-gauge, high-density polyethylene plastic or similar material which is hollow and sealed air tight. While normally not necessary for flotation, pontoons 20, 21, 22 and 23 may contain a highly buoyant foam or plastic. Construction of the pontoons out of a heavy-gauge plastic ensure their survivability in the adverse conditions often associated with marine environments, and contribute to the floating dock structure's weather resistance and ease of maintenance. For instance, polyethylene pontoons do not require repaint, do not encounter electrolysis, and are impervious to destructive marine borers, which deteriorates conventional docks. As can be seen in FIGS. 1 through 4, each of the pontoons 20, 21, 22 and 23 are placed such that an overall rectangular shape is achieved, thus providing for a stable pontoon float base 2. In this manner then, the pontoon float base 2 is constructed of two sets of parallel pontoons. The first set of parallel pontoons, pontoons 20 and 22, are placed as the pair of outside pontoons. The second set of parallel pontoons, pontoons 21 and 23, are placed as the pair of inside pontoons, perpendicular to the outside pontoons. Pontoons 20 and 22 are typically spaced to provide a dock of 6 feet in width, although the range can be between 3 and 10 feet. Pontoons 21 and 23, may be of any length, but are typically provided in sections 20–24 feet in length. The ends of each of the inside pontoons 21 and 23 are integrally connected to the outside pontoons 20 and 22 by means of a plastic joining process with the plastic seam shown at seam 5. As also shown in the Figures, pontoon 21 and 23 are each placed respectively at opposing ends of the outside pontoons 20 and 22. It is to be understood, of course, that the construction of the pontoon float base 2 is not to be limited to only four pontoons, and in fact more or less than four pontoons may be used. Further, while the pontoons may be of any length, due to transportability requirements, several dock structures 1 may be formed to satisfy the desired length.

Also, the elevation or height of the dock may be changed by the selection of different diameter pontoons.

Figure 2:
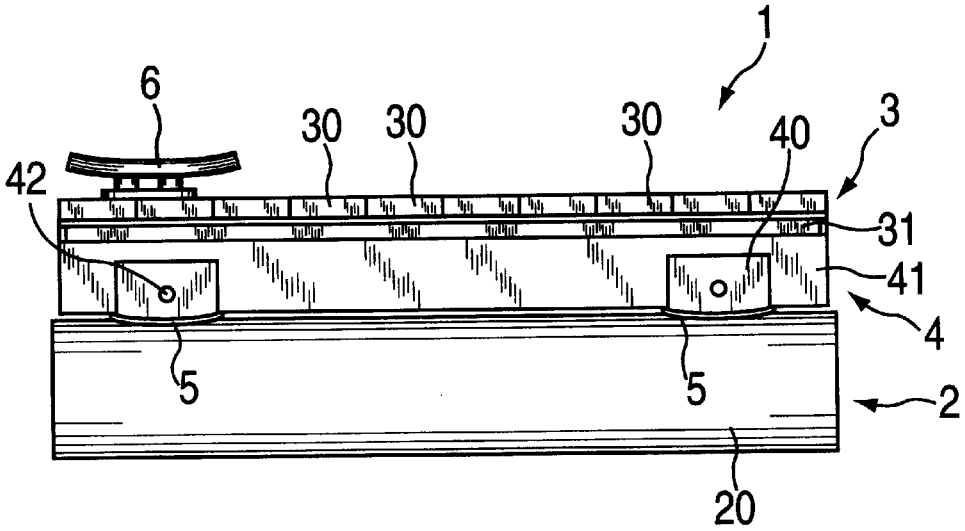
FIG. 2 illustrates a side view of the floating dock structure, according to an embodiment of the present invention.
Figure 3:
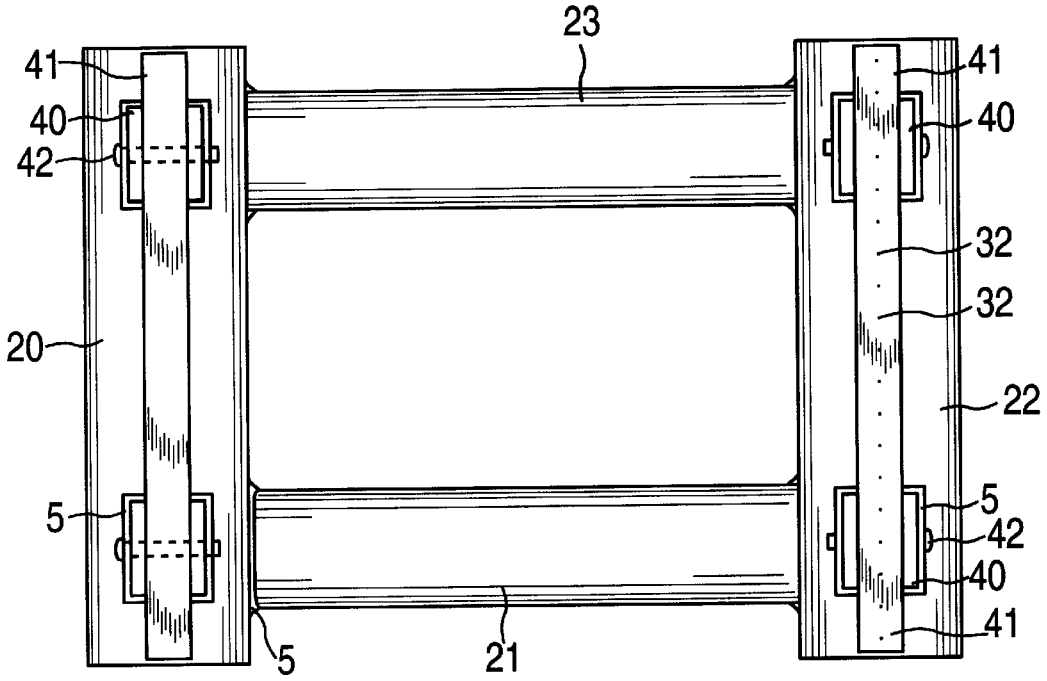
FIG. 3 illustrates a top view of the floating dock structure without the deck crosspieces in place, according to an embodiment of the present invention.
Figure 4:
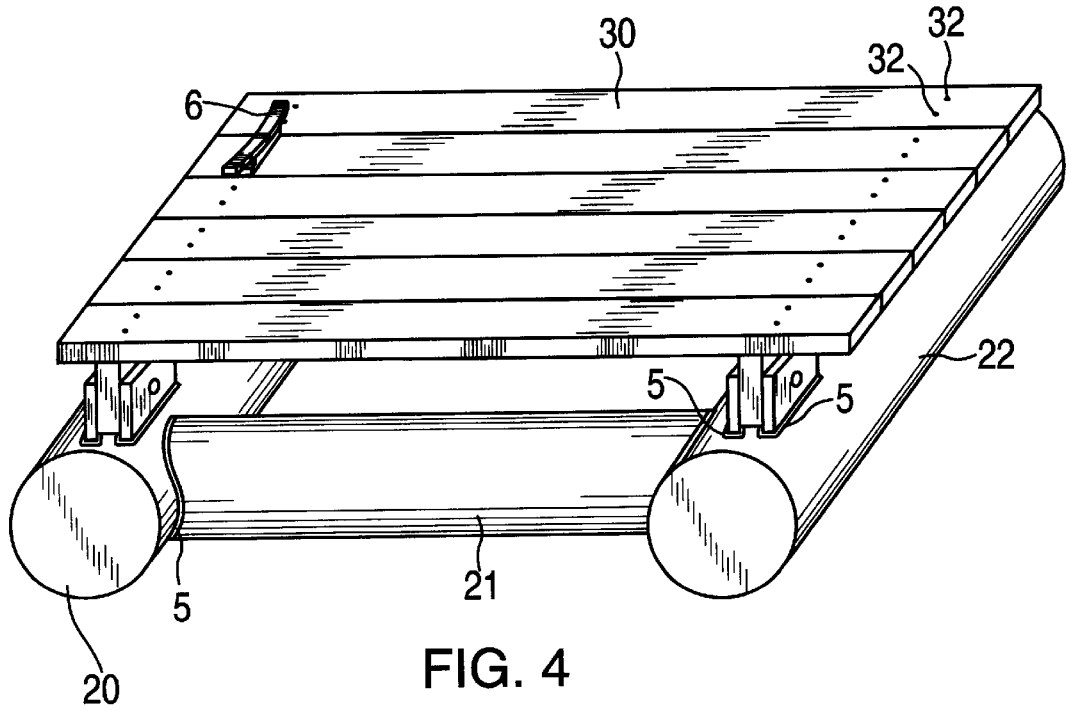
FIG. 4 illustrates a top angled perspective view of the floating dock structure, according to an embodiment of the present invention.

Turning now to the construction of the deck 3, it is constructed to reside securely in position over the pontoon float base 2. The deck 3 itself is constructed from a number of deck crosspieces 30. The deck crosspieces 30 are preferably constructed of a solid weather-resistant wood, such as pressure-treated pine or copper chromate arsenate (CCA) treated pine, but can be of any material suitable as a platform surface (e.g., plastic, or hardwoods). As shown in FIGS. 1, 2 and 4, each of the deck crosspieces 30 are arranged in parallel in a side-by-side fashion to create the platform surface for deck 3.

The crosspieces 30 may be joined together by a suitable means, such as by a rope or a leather strap, or may be individually fastened to the floating dock structure 1. Preferably the deck crosspieces 30 are securely fastened to the deck support base 4 by a number of deck securers 32. The deck securers 32 can be a series of nails and/or screws hammered and/or screwed respectively through the deck crosspieces 30 and into a portion of the deck support brace 4. A support beam 31 may further be added at each end of deck 3 perpendicular to the deck crosspieces 30 as a means of additionally securing the crosspieces together and as a means of adding ballast to help provide greater balance/equilibrium for the floating dock structure 1.

Turning now to the construction of the deck support brace 4, yokes 40 are integrally connected to each end of pontoons 22 by means of plastic joining with the seam 5. Yoke 40 and a deck support beam 41 act in conjunction to securely fasten the deck 3 over the pontoon float base 2. The deck support beam 41 is securely fastened to the deck 3 by a number of the deck securers 32. The deck support beam 41 is then attached to the yoke 40 by a bolt 42 placed through a hole bored through the deck support beam 41 and the yoke 40.

Preferably the fore and aft yokes 40 are arranged such that the two yokes form a parallel pair, with a spacing between the two yokes to form a slot in which the deck support beam 41 is secured. Further, a pair of yokes 40 can thus be placed at each end of a pontoon, with the deck support beam 41 essentially running between the two pairs of yokes and over the length of the pontoon over which it is placed. For instance, as shown in the FIGS. 1 through 4, two pairs of yokes 40 are integrally connected and placed upon opposite ends of each of the pontoons 20 and 22, with deck support beam 41 running the length of each of those pontoons. A number of the bolts 42 then act to securely fasten each of the deck support beams 41 into the slots created by the pairs of yokes 40. As mentioned above, the deck securers 32 (e.g., nails, screws, etc.) secure each of the deck cross pieces 30 of the deck 3 to the deck support beams 41. It is to be understood, of course, that the positioning of the yokes 40 is not to be limited to that shown in the figures and that they may be arranged such that the two deck support beams 41, instead of running the length of pontoons 20 and 22, run the length of pontoons 21 and 23, and further that they may instead be in fact placed on pontoons 21 and 23.

Figure 5:
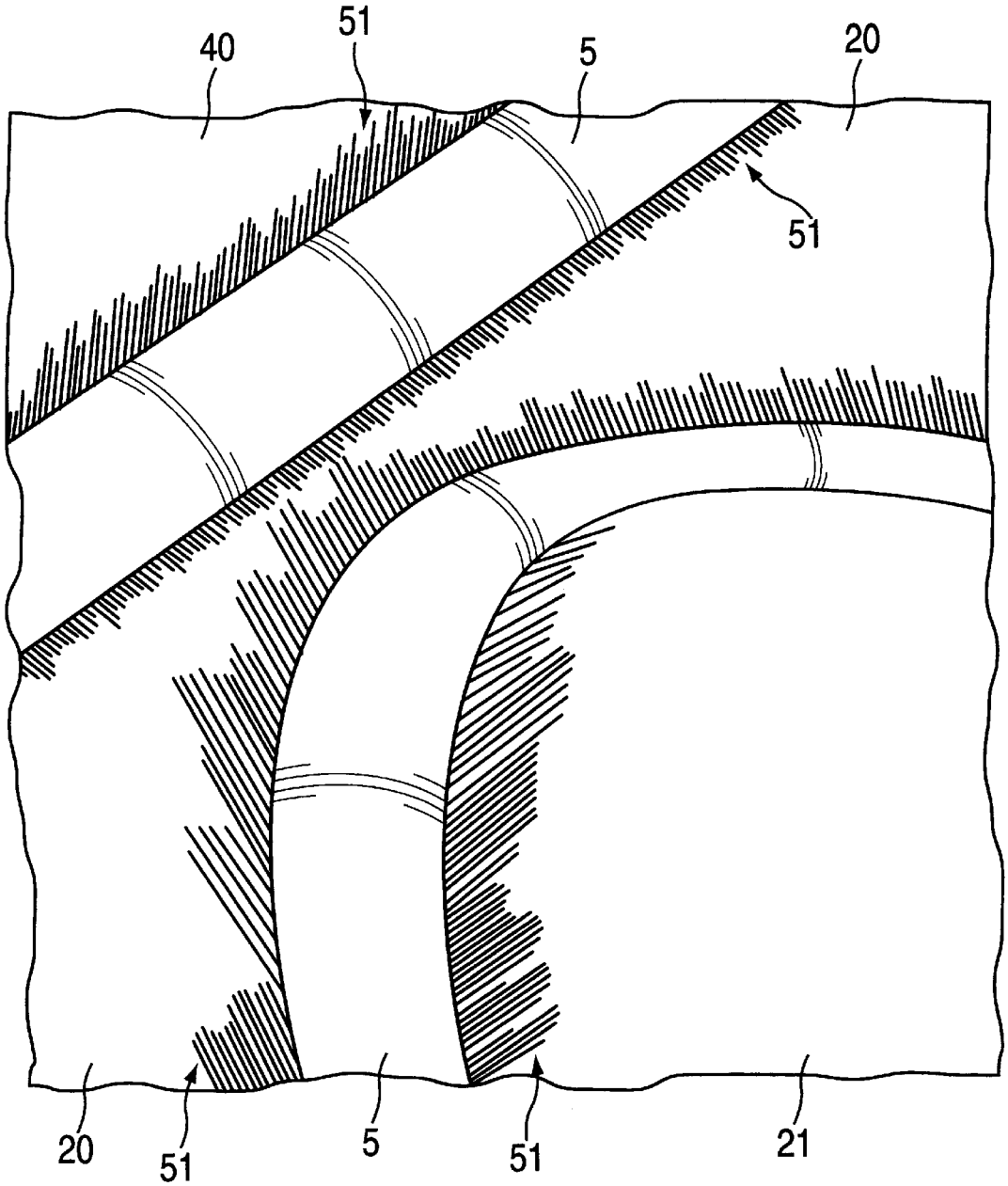
FIG. 5 illustrates a close view of the water-tight seal of adjoining pontoons by use of a plastic joining process, according to an embodiment of the present invention.

Referring to FIG. 5, a close view of the integral connection of adjoining pontoons and the integral connection of a yoke to one of the pontoons is shown. As shown in this figure, inner pontoon 21 and yoke 40 are each integrally connected to outer pontoon 20 by a seam 5 formed by the previously described plastic joining process. Such construction of an integral connection of the separate pieces is achieved by first form fitting the pieces together, and then joining the pieces together at the form fitted joint. Form fitting of the pieces together is accomplished by shape cutting of the heavy-gauge plastic which is preferably at least one-half inch thick for pontoons of a diameter between 10 inches and 24 inches for a typical 6 foot by 20 foot dock. For instance, the end of inner pontoon 21 is shape cut to fit smoothly over the curved surface of outer pontoon 20. Joining of the pieces together is then accomplished by using a thick seam of heated plastic 5. For additional construction stability, serrations 51 may be etched into the surface of the separate pieces to be integrally connected around the positioning of the form fitting joints between separate pieces. For instance, serrations 51 may be etched into the surface of pontoons 20 and 21 around the form fitting joint of the two pontoons. The heated plastic 5 may then be placed over the form fitted joint and the surrounding serrations 51 in order to give the plastic seam 5 a rough surface with which to bind and thereby securely hold the two pontoons together.

Figure 6:
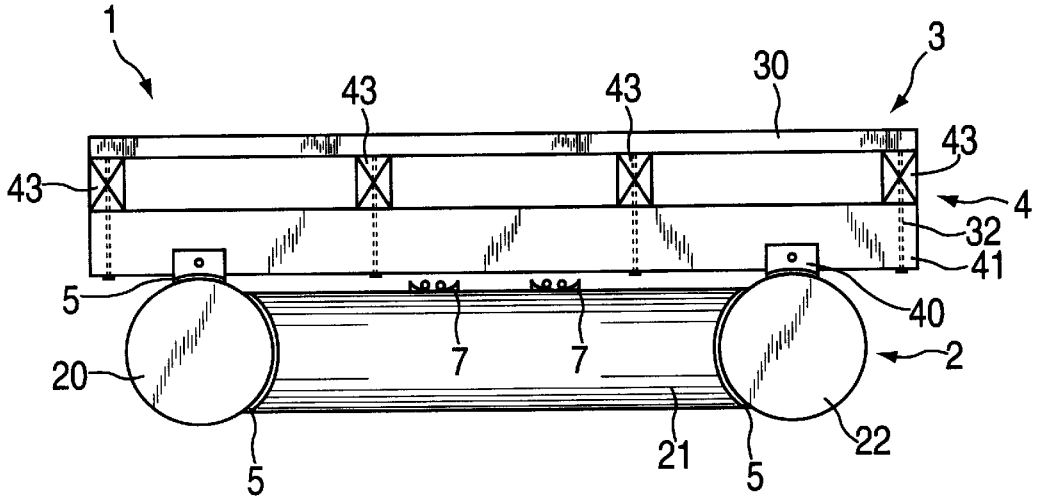
FIG. 6 illustrates an end view of an elevated floating dock structure, according to an alternate embodiment of the present invention.

Referring to FIG. 6, an alternative embodiment of the present invention of the floating dock structure 1 is shown. In this embodiment, the deck 3 is further elevated above the pontoon float base 2 by means of additional structures built into the deck support brace 4. This vertical elevation of the deck 3 is achieved by adding a number of additional deck support beams 43, which can be placed either perpendicular to or in parallel with the original deck support beams 41. It is to be understood, of course, that even higher elevations can be achieved by further adding an additional number of deck support beams 43. Such additional construction for even higher elevation of the deck 3 may also be either perpendicular to or in parallel with the built-upon additional support beams 43 or the original deck support beams 41. In the case where vertical elevation of the deck 3 is desirable, the deck 3, and the individual deck cross pieces 30, will be securely fastened to the additional deck support beams 43. Preferably, such secure fastening comprises deck securers 32 (as described above) which proceed through the length of the vertical elevation. Alternatively, additional vertical elevation may be obtained by utilization of a larger pontoon diameter.

Further, as shown in FIG. 6 and as mentioned above, it is to be noted that the construction of the deck support brace 4 may be positioned such that it runs parallel to the inner pontoons 21 and 23. This is an alternative embodiment of the construction of the deck support brace 4 as shown in FIGS. 1 through 4, in which the deck support brace 4 runs parallel to the outer pontoons 20 and 22. Also further, as also shown in FIG. 6, it is to be noted that a number of utility trays 7 may be securely fastened on top of either the deck 3 or each of the pontoons 20, 21, 22 and 23 such that items may be placed or stored.

Thus, as can be seen from the above, the present invention allows for a stabile, easy to construct, all-weather resistant, maintenance free, easily transportable floating dock structure. Such a dock can be used in both fresh and salt water environments and can be used for any number of water sport or recreational or commercial activities.

It is to be noted that in the foregoing description, the method and apparatus of the present invention have been described with reference to a number of examples that are not to be considered limiting. Rather, it is to be understood and expected that variations in the principles of the method and apparatus herein disclosed may be made by one skilled in the art and it is intended that such modifications, changes, and/or substitutions are to be included within the scope of the present invention as set forth in the appended claims. The specification and the drawings are accordingly to be regarded in an illustrative rather than in a restrictive sense.

What is claimed is:

1. A floating dock structure suitable for both salt and fresh water applications which is resistant to corrosive elements, including electrolysis, comprising:

a deck;

a deck support brace, to which the deck is securely fastened; and a heavy-gauge plastic pontoon float base, to which the deck support brace is integrally connected by a plastic joining process, further comprising:

a first pair of plastic pontoons, each one of the first pair of pontoons positioned in parallel to the other; and a second pair of plastic pontoons, situated both inside of and perpendicular to the first pair of plastic pontoons so as to create a rectangular shape;

wherein the first pair and the second pair of plastic pontoons are integrally connected to each other by the plastic joining process.

2. The floating dock structure according to claim 1, wherein the deck comprises at least one crosspiece.

3. The floating dock structure according to claim 2, wherein at least one crosspiece is constructed of a material that comprises at least one of a treated wood, a plastic, and a combination of treated wood and plastic.

4. The floating dock structure according to claim 1, further comprising:

at least one stabilization beam, securely fastened to at least one end of the deck.

5. The floating dock structure according to claim 1, wherein the deck is securely fastened to the deck support brace by at least one deck securer.

6. The floating dock structure according to claim 1, wherein the deck support brace further comprises:

at least one deck support yoke;

at least one deck support beam; and at least one bolt, with which the at least one deck support beam is secured to the at least one deck support yoke.

7. The floating dock structure according to claim 6, wherein the at least one deck support yoke is integrally connected to one pontoon of the first and second pairs of pontoons by a plastic joining process.

8. The floating dock structure according to claim 6, wherein the at least one deck support beam is securely fastened to the deck.

9. The floating dock structure according to claim 1, wherein the first and second pairs of plastic pontoons are constructed of a high-density polyethylene, heavy-gauge plastic having a thickness of at least one-half inch.

10. The floating dock structure according to claim 1, wherein the first and second pairs of plastic pontoons are constructed of heavy-gauge, polyethylene plastic and contain therein one of a buoyant foam or plastic.

11. A floating dock structure suitable for both salt and fresh water applications which is resistant to corrosive elements, and generally impervious to marine borers, comprising:

a deck;

a deck support beam, to which the deck is securely fastened;

a pair of deck support yokes, each one spaced apart from the other so as to form a slot in which the deck support beam is positioned;

a bolt, bored through the deck support beam and the pair of deck support yokes so as to secure the positioning of the deck support beam in the slot between the pair of deck support yokes; and a plastic pontoon float base, to which the pair of deck support yokes are integrally connected by a plastic joining, including any one of fusion, laser, microwave, friction or dielectric joining.

12. The floating dock structure according to claim 11, wherein the deck is securely fastened to the deck support beam by at least one deck securer.

13. The floating dock structure according to claim 11, wherein at least one cleat is fastened to the deck.

14. The floating dock structure according to claim 11, further comprising:

at least one additional deck support beam, inserted between the deck and the deck support beam to achieve additional elevation of the deck.

15. The floating dock structure according to claim 11, wherein the pontoon float base is constructed of a heavy-gauge, high-density, polyethylene plastic.

16. The floating dock structure according to claim 11, wherein the pontoon float base further comprises:

at least one first plastic pontoon; and at least one second plastic pontoon, integrally connected to the at least one first pontoon by a plastic joining process and wherein said plastic is a heavy-gauge, high-density polyethylene.

17. The floating dock structure according to claim 16, wherein a serration is cut into an outer surface of at least one of the at least one first plastic pontoon and the at least one second plastic pontoon around a juncture at which the integral connection is made.

18. The floating dock structure according to claim 16, wherein a juncture at which the at least one second pontoon is integrally connected to the at least one first pontoon is sealed water-tight by the plastic joining process.

19. The floating dock structure according to claim 11, further comprising:

at least one utility tray, attached to the floating dock structure.

20. A method of constructing a floating dock structure, the method comprising:

cutting an end of a first high-density polyethylene plastic pontoon so that the end can be form fitted onto an outer side surface of a second high-density polyethylene plastic pontoon;

joining the form fitted end of the first pontoon onto the outer side surface of the second pontoon with a heated plastic so as to integrally connect the first pontoon to the second pontoon;

joining at least one deck support yoke onto one of the first and second pontoons with a plastic joining process;

bolting at least one deck support beam to at least one deck support yoke; and fastening a deck to at least one deck support beam.

21. A unitary floatation structure suitable for supporting and having a deck mounted thereon comprising:

a unitary float structure formed of a pair of spaced parallel heavy gauge plastic tubular members and at least another pair of spaced parallel heavy gauge plastic tubular members disposed perpendicular to said first pair of spaced parallel tubular members and having the ends thereof fixedly joined to the outer surface of said first pair of tubular members by a plastic joining process, each of said first pair of members having the ends thereof sealed closed to provide flotation to the unitary floatation structure; and a plurality of upwardly extending plastic support braces fixedly joined to at least some of said tubular members by a plastic joining process.

22. A unitary floatation structure as set forth in claim 21 which further comprises a deck spaced above said unitary floating dock structure securely fastened to said plastic support braces.

23. The floating dock structure according to claim 21, wherein the plastic tubular members are constructed of a high-density polyethylene, heavy-gauge plastic having a thickness of at least one-half inch.

24. The floating dock structure according to claim 21, wherein said tubular members are made of high density polyethylene plastic.

* * * * *